US007548024B2

(12) United States Patent
Setoguchi et al.

(10) Patent No.: US 7,548,024 B2
(45) Date of Patent: Jun. 16, 2009

(54) PLASMA DISPLAY PANEL AND METHOD FOR MANUFACTURING THE SAME

(75) Inventors: Noriaki Setoguchi, Miyazaki (JP); Koji Ohira, Miyazaki (JP)

(73) Assignee: Fujitsu Hitachi Plasma Display Limited, Higashimorokata (JP)

( * ) Notice: Subject to any disclaimer, the term of this patent is extended or adjusted under 35 U.S.C. 154(b) by 435 days.

(21) Appl. No.: 11/593,062

(22) Filed: Nov. 6, 2006

(65) Prior Publication Data

US 2007/0103074 A1 May 10, 2007

(30) Foreign Application Priority Data

Nov. 10, 2005 (JP) ..... 2005-326587

(51) Int. Cl.
*H01J 17/49* (2006.01)

(52) U.S. Cl. ..... 313/582; 313/584

(58) Field of Classification Search ..... 313/582, 313/584, 485

See application file for complete search history.

(56) References Cited

U.S. PATENT DOCUMENTS 5,703,433 A * 12/1997 Fujii et al. ..... 313/484

FOREIGN PATENT DOCUMENTS

JP 3007751 11/1999
JP 2000-67763 3/2000

* cited by examiner

*Primary Examiner*—Vip Patel
(74) *Attorney, Agent, or Firm*—Staas & Halsey LLP

(57) ABSTRACT

A plasma display panel includes first and second substrates opposed to each other for defining a space filled with discharge gas, a screen made up of cells arranged in the row and column directions, display electrodes arranged on the first substrate, the display electrodes extending in the row direction, band-like partitions arranged in parallel on the second substrate for dividing the gas filled space into columns, and fluorescent material layers sticking to side faces of the partitions and inner surfaces between the partitions on the columns, each of the fluorescent material layers extending across cells. The thickness of the fluorescent material layer at a part sticking to the side face of the partition and overlapping with the display electrodes is designed to be smaller than the thickness at a part sticking to the side face of the partition in the vicinity of the surface discharge gap.

5 Claims, 7 Drawing Sheets

PLASMA DISPLAY PANEL AND METHOD FOR MANUFACTURING THE SAME

BACKGROUND OF THE INVENTION

1. Field of the Invention

The present invention relates to a surface discharge type plasma display panel. More specifically, the present invention relates to an improvement of an arrangement of fluorescent materials.

2. Description of the Prior Art

The surface discharge type plasma display panel includes row electrodes arranged as display electrodes for generating surface discharges, a dielectric layer that covers the row electrode, column electrodes that cross the display electrodes, partitions that are discharge barriers between cells, and fluorescent materials for reproducing colors. In general, the row electrodes and the dielectric layer are arranged on a front substrate, while the column electrodes, the partitions and the fluorescent materials are arranged on a back substrate. A screen is made up of a plurality of cells (display elements) arranged in the row and column directions. A pair of row electrodes is arranged on each of the rows, and one column electrode is arranged on each of the columns.

Arrangement patterns of the partitions are classified roughly into a stripe pattern and a mesh pattern. In the former arrangement pattern, a gas filled space defined by the front substrate and the back substrate is divided into columns in accordance with a cell arrangement. In the latter arrangement pattern, the gas filled space is divided in both the row and column directions in accordance with the cell arrangement. The stripe pattern is superior to the mesh pattern in facility of forming the partitions. In the case of the stripe pattern, a plurality of partitions having elongated band-like upper faces extending over the whole length of the column are arranged between column electrodes in a plan view.

In each cell, a side face of the partition is utilized as a part of a light emitting surface. More specifically, the fluorescent material is applied to an inner surface between the partitions and side faces of the partitions like a continuous layer. According to this structure, luminance of display is enhanced compared with the case where the fluorescent material is applied only to an inner surface between the partitions.

In a typical arrangement of the fluorescent materials for a plasma display panel having partitions arranged in the stripe pattern, an elongated fluorescent material layer extending continuously from an end to the other end is formed on each column. This fluorescent material layer includes fluorescent materials corresponding to cells on one column, and therefore these cells have the same light emission color.

The fluorescent material layers are formed by a screen printing method or a dispenser method. These methods are superior to other methods using a photosensitive material in smaller number of steps and lower cost of materials, so they are suitable for mass production. In the case of the screen printing method, a mask having elongated slit-like openings is used for arranging three types of fluorescent material paste of red, green and blue colors on predetermined columns. In the case of the dispenser method, a nozzle having a bore diameter smaller than a width of the column is used.

As a method for applying the fluorescent material on the side face of the partition, there is a method disclosed in Japanese patent No. 3007751. In this method, fluorescent material paste having good fluidity and viscosity of approximately 4 Pa·s (=40 poise) is applied so as to fill spaces between partitions, and volume of the paste is reduced by drying and burning the paste. A thickness of the fluorescent material layer after completion depends on a content of the fluorescent material in the paste.

In addition, as to a thickness of the fluorescent material layer, Japanese unexamined patent publication No. 2000-67763 discloses a method of filling up a part of the elongated band-like fluorescent material layer extending over the entire length of the column corresponding to a boundary between cells higher than other portions so that a surface area of the fluorescent material in each cell is increased.

In order to improve the luminance of the display, it is desirable to make the fluorescent material thick in each cell within the bounds of no influence on the discharge. In particular, it is desirable to make the fluorescent material layer thick on sides of the partitions so that the surface of the fluorescent material be close to the discharge for the plasma display panel that limits discharge current for enhancing light emission efficiency by limiting the discharge to the middle portion of the cell and its vicinity with a designed shape of the display electrode.

However, if the fluorescent material layer is made thick all over the length of the column as a whole, discharge errors may occur easily due to a decrease of the effective electrode area for discharge and a decrease of the discharge space, resulting in an unstable display operation.

SUMMARY OF THE INVENTION

An object of the present invention is to provide a cell structure that is advantageous to an improvement of luminance.

A plasma display panel according to an embodiment of the present invention includes first and second substrates opposed to each other for defining a space filled with discharge gas, a screen made up of a plurality of cells arranged in row and column directions, display electrodes arranged on the first substrate for generating surface discharges, the display electrodes extending in the row direction, a plurality of band-like partitions arranged in parallel on the second substrate for dividing the gas filled space into columns, and fluorescent material layers sticking to side faces of the partitions and inner surfaces between the partitions on the columns, each of the fluorescent material layers having a band-like shape extending across a plurality of cells in a plan view. The thickness of the fluorescent material layer at a part sticking to the side face of the partition and overlapping with the display electrode is smaller than the thickness of the fluorescent material layer at a part sticking to the side face of the partition in a vicinity of a surface discharge gap.

Since the thickness of the fluorescent material layer in the vicinity of the display electrode gap in each cell is made large, the surface of the fluorescent material becomes close to the discharge. Therefore, light emission is enhanced. Since the thickness of the fluorescent material layer at the part sticking to the side face of the partition and overlapping with the display electrodes is made small, a decrease of an effective electrode area can be prevented, which causes a secondary effect of reducing quantity of fluorescent material. The state of "overlapping with display electrode" means to be located between the display electrode and the second substrate, and it is not limited to lamination on a plane. Even if the fluorescent material overlapping with the metal portion of the display electrode is made thin, luminance of the cell is not affected although quantity of light shielded by the metal portion is reduced.

The fluorescent material layer is formed by using a method of pattern printing of fluorescent material paste in a space between the partitions. The pattern printing includes applying the paste by using a dispenser. When the pattern printing is performed, a mask for pattern printing having a plurality of apertures arranged discretely along the partition is disposed above the substrate on which the plurality of band-like partitions is formed. Through the apertures of the mask, the fluorescent material paste is printed in the space between the partitions. The viscosity of the paste is adjusted so that bodies of the paste passing through neighboring apertures are combined in the space between the partitions and that unevenness of the thickness of the printed paste remains in accordance with the mask pattern.

According to the present invention, it is possible to realize a plasma display panel that is capable of improving luminance and securing stable operation unlike the conventional structure in which the fluorescent material layer extends the entire length of the column and the thickness of the fluorescent material layer is uniform over the entire length.

DESCRIPTION OF THE PREFERRED EMBODIMENTS

The invention will now be described in detail with reference to the attached drawings.

Figure 1:
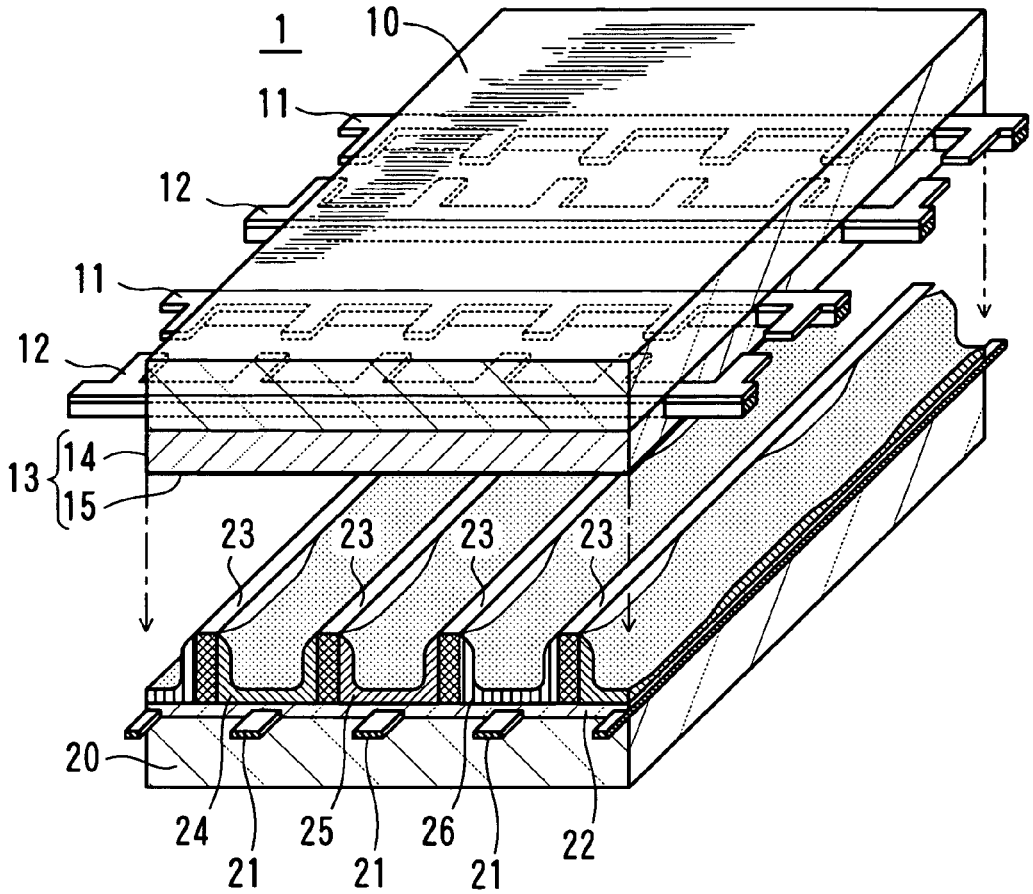
FIG. 1 is an exploded perspective view showing a structure of a plasma display panel according to an embodiment of the present invention.
Figure 2:
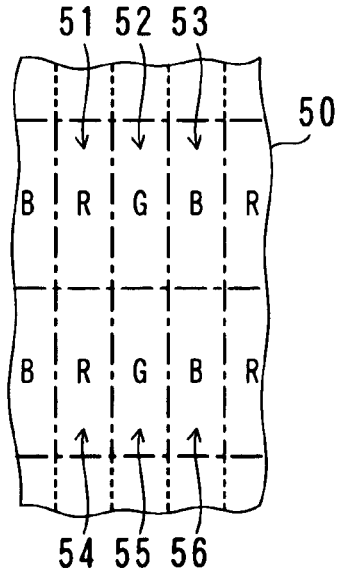
FIG. 2 is a plan view showing a color arrangement of a screen.

FIG. 1 is an exploded perspective view showing a structure of a plasma display panel according to an embodiment of the present invention, and FIG. 2 is a plan view showing a color arrangement of a screen. In FIG. 1, a part of the plasma display panel 1 corresponding to six cells (cells 51, 52, 53, 54, 55 and 56 on a screen 50 shown in FIG. 2) is drawn.

The plasma display panel 1 includes a front glass substrate 10, a back glass substrate 20, and discharge gas (not shown) filled in the space between the substrates.

On the inner surface of the glass substrate 10, first row electrodes 11 and second row electrodes 12 are arranged as display electrodes for generating surface discharges. The row electrode 11 and the row electrode 12 constitute an electrode pair on each row. These electrodes are covered with an insulating layer 13. The insulating layer 13 is a laminate of a dielectric layer 14 and a thin protection film 15.

On the inner surface of the glass substrate 20, the column electrodes 21 are arranged, and the electrodes are covered with a dielectric layer 22. On the dielectric layer 22, a plurality of band-like partitions 23 extending in the same direction as the column electrode 21 is arranged in parallel. The partition pattern is a stripe pattern. The partition 23 actually contacts the protection film 15 although they are separated in FIG. 1.

Between neighboring partitions 23, as structural elements unique to the present invention, a fluorescent material layer 24 of red color (R), a fluorescent material layer 25 of green color (G) and a fluorescent material layer 26 of blue color (B) are formed. Each of the fluorescent material layers 24, 25 and 26 has a continuous band-like shape extending over a plurality of cells along the partition 23, and it is a layer having a set nonuniform thickness as described later.

As shown in FIG. 2, the screen 50 is made up of many cells arranged in the row and column directions. In FIG. 2, a part of row that includes the three cells 51, 52 and 53 and a part of columns that includes the three cells 54, 55 and 56 are illustrated. The color arrangement of the screen 50 is a stripe arrangement in which cells arranged on each column have the same light emission color, and neighboring cells between columns have different light emission colors. Three cells arranged in the horizontal direction correspond to one pixel of an image.

Figure 3:
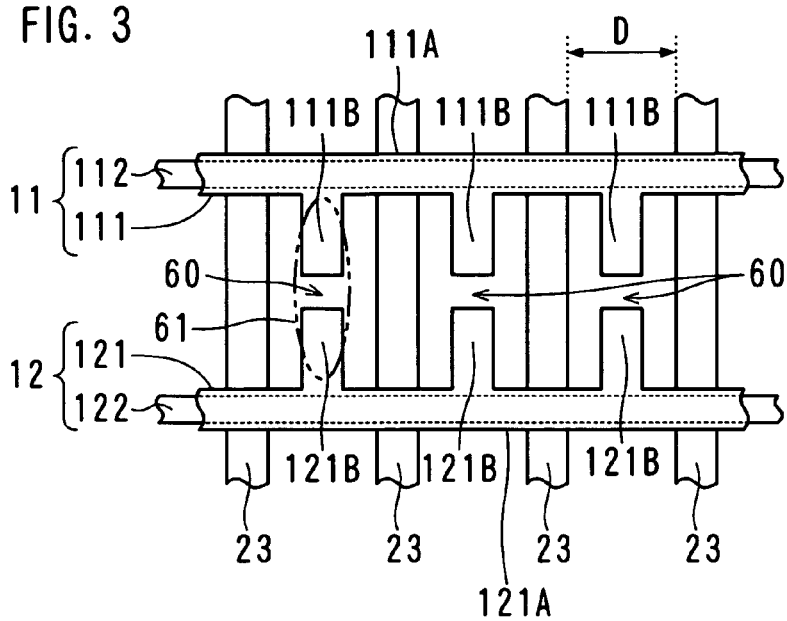
FIG. 3 is a plan view showing a shape of a row electrode.

FIG. 3 is a plan view showing a shape of a row electrode.

The row electrode 11 is a laminate of a transparent conductive film 111 and a metal film 112. The transparent conductive film 111 is patterned to be a shape having a band-like portion 111A extending across a plurality of cells arranged in the row direction and a plurality of protruding portions 111B that protrudes from the band-like portion 111A toward the row electrode 12 that makes a pair with the row electrode 11 in each cell. The metal film 112 is patterned to have a band-like shape of a predetermined width, and the entire area of the metal film 112 overlaps the band-like portion 11A.

Similarly, the row electrode 12 is a laminate of a transparent conductive film 121 and a metal film 122. The transparent conductive film 121 is patterned to be a shape having a band-like portion 121A extending across a plurality of cells arranged in the row direction and a plurality of protruding portions 121B that protrudes from the band-like portion 121A toward the row electrode 11 that makes a pair with the row electrode 12 in each cell. The metal film 122 is patterned to have a band-like shape of a predetermined width, and the entire area of the metal film 122 overlaps the band-like portion 121A.

In each cell, the protruding portion 111B of the row electrode 11 and the protruding portion 121B of the row electrode 12 form a surface discharge gap 60 (a display electrode gap). A size of the protruding portions 111B and 121B in the longitudinal direction of the band-like portion is smaller than a distance D between the upper faces of the neighboring partitions 23. In this structure, an effective extension of a surface discharge 61 is limited to the middle portion of the cell in the row direction in which the protruding portion 111B and the protruding portion 121B are arranged.

As a variation, the band-like portions 111A and 121A of the transparent conductive films 111 and 121 may be omitted, and the protruding portions 111B and 121B that are separated for each cell are arranged so as to overlap with the metal films 112 and 122, respectively forming a lamination structure. In addition, shapes of the protruding portions 111B and 121B are not limited to the simple quadrangle but may be other shapes including a T-shaped portion made up of a band extending in the row direction and a band extending in the column direction.

Next, a shape of the fluorescent material layer unique to the present invention will be described.

Figure 4:
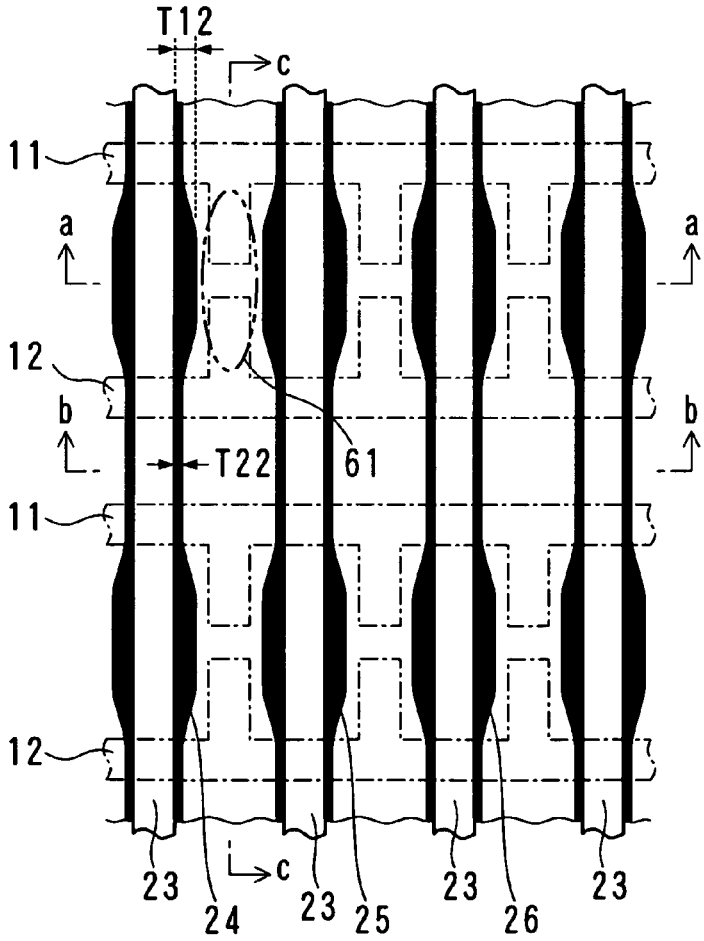
FIG. 4 is a plan view showing a relationship between a shape of a fluorescent material layer and a row electrode.
Figure 5:
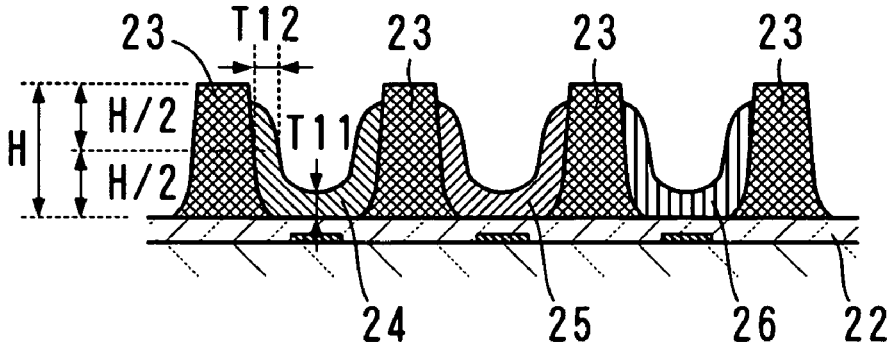
FIG. 5 is a cross sectional view showing a cell structure corresponding to the a-a section in FIG. 4.
Figure 6:
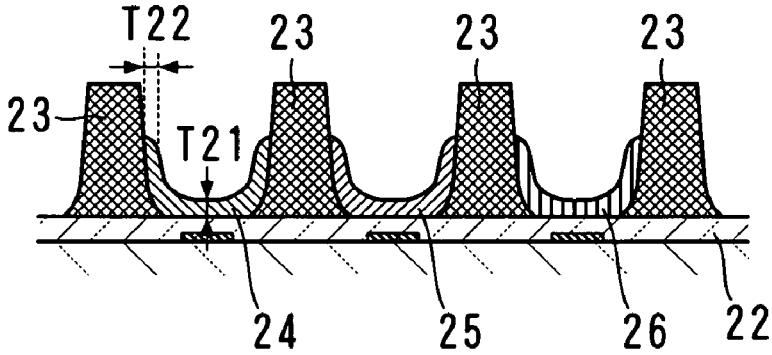
FIG. 6 is a cross sectional view showing a cell structure corresponding to the b-b section in FIG. 4.
Figure 7:
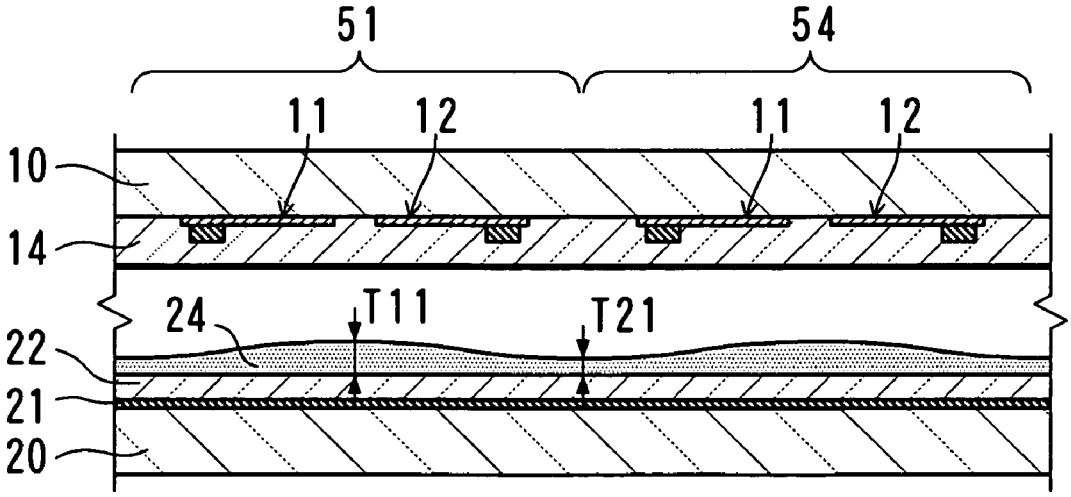
FIG. 7 is a cross sectional view showing a cell structure corresponding to the c-c section in FIG. 4.

FIG. 4 is a plan view showing a relationship between the shape of the fluorescent material layer and the row electrodes. FIGS. 5, 6 and 7 are cross sectional views showing cell structures corresponding to the a-a section, the b-b section and the c-c section in FIG. 4 respectively. The materials of the fluorescent material layers 24, 25 and 26 are different, but the shapes of them are the same. Therefore, the fluorescent material layer 24 of the red color will be described as a typical example as follows.

The fluorescent material layer 24 is continuous over the entire length of the column defined by the neighboring partitions 23. FIG. 4 shows a part corresponding to two cells. Since the fluorescent material layer 24 is continuous, the fluorescent material (a part of the fluorescent material layer 24) of each cell is naturally continuous with the fluorescent material of the neighboring cell arranged along the partition 23. However, the thickness of the fluorescent material layer 24 differs depending on a position along the partition 23 (in the column direction). In other words, as shown in FIG. 4 well, the thickness T22 of the fluorescent material sticking to the side face of the partition at the vicinity of the display electrode and the middle part of the display electrode gap between cells is smaller than the thickness T12 of the fluorescent material sticking to the side face of the partition at the display electrode gap and its vicinity in each cell. In addition, as understood from comparison between FIGS. 5 and 6, and as shown in FIG. 7 well, the thickness T11 of the fluorescent material sticking to the inner surface between partitions at the vicinity of the display electrode gap in each cell is larger than the thickness T21 of the fluorescent material sticking to the inner surface between partitions at other areas. Note that the inner surface between partitions in this example is the upper face of the back dielectric layer 22.

In the strict sense, the side face of the partition 23 is an inclined face as shown in FIGS. 5 and 6, so the thickness of the fluorescent material is different between the upper portion and the lower portion of the partition 23. Therefore, in this description, the thicknesses T12 and T22 of the fluorescent material sticking to the side face of the partition are defined as thicknesses at a height that is a half of the height H of the partition 23. In addition, the thickness of the fluorescent material on the inner surface between the partitions is different between the middle portion and the right or left end portion. Therefore, in this description, the thicknesses T11 and T21 of the fluorescent material sticking to the inner surface between the partitions are defined as thicknesses at the intermediate position between the neighboring partitions, i.e., the middle portion of the cell in the row direction.

When the thickness of the fluorescent material layer is increased at the position close to the display electrode gap in each cell, the light emission is enhanced because the surface of the fluorescent material becomes close to the discharge. When the thickness of the fluorescent material layer is decreased at the area overlapping the row electrodes 11 and 12 (more strictly, the band-like portion thereof), a discharge start voltage is prevented from being increased resulting in a stable operation. In addition, when the thickness of the fluorescent material layer that is located at a boundary between neighboring cells and does not contribute substantially to the light emission is decreased, substances of the fluorescent material can be reduced. Since the fluorescent material in each cell is continuous with the fluorescent material in the neighboring cell, a variation in the shape of the fluorescent material between cells is hardly generated unlike the case where the fluorescent material is separated for each cell.

The fluorescent material layers 24, 25 and 26 having uneven thicknesses as described above are formed by the following method.

Figure 8:
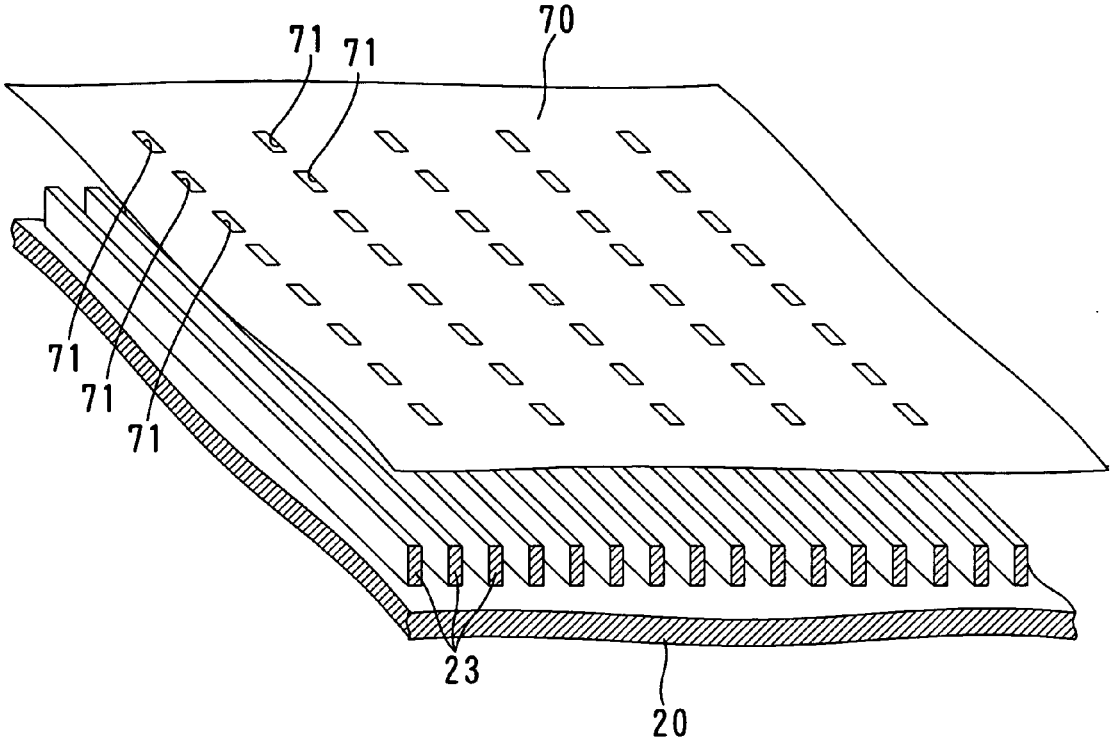
FIG. 8 is a perspective view showing a structure of a mask that is used for forming the fluorescent material layer.
Figure 9:
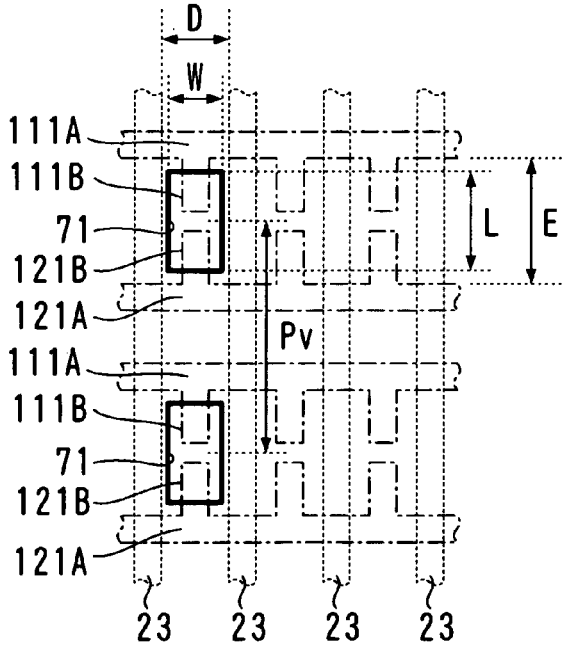
FIG. 9 is a plan view showing a relationship among positions of apertures of the mask, partitions and row electrodes.

FIG. 8 is a perspective view showing a structure of a mask that is used for forming the fluorescent material layer, and FIG. 9 is a plan view showing a relationship among positions of apertures of the mask, partitions and row electrodes.

The fluorescent material layer 24 is formed by using the method of printing a pattern of fluorescent material paste in the space between the partitions. When the pattern is printed, a pattern printing mask 70 having a plurality of apertures 71 arranged discretely along the partition 23 is disposed above the substrate 20 on which the plurality of band-like partitions 23.

An arrangement pitch of the apertures 71 along the partition 23 is equal to an arrangement pitch of the display electrode pair (i.e., a cell pitch in the column direction) Pv as shown in FIG. 9. In order to arrange the fluorescent material layers 24 every three columns, i.e., with a space of two columns between the fluorescent material layers 24, the arrangement pitch of the apertures 71 in the arrangement direction of the partition 23 is three times the arrangement pitch of the partition 23.

As shown in FIG. 9, the shape of each aperture 71 in this example is a quadrangle elongated in the column direction. In order to prevent the fluorescent material from depositing on the upper face of the partition 23, a width W of the aperture 71 is designed to be a value smaller than the distance D between upper faces of neighboring partitions 23 (a design value of a partition space). In addition, in this example, the length L of the aperture 71 that defines the position of the thick portion of the fluorescent material layer 24 is set to a value a little shorter than a distance E between the band-like portion 111A and the band-like portion 121A of the display electrode pair. However, a shape and a size of the aperture 71 should be determined appropriately in consideration of viscosity of the fluorescent material paste in accordance with a shape design of the fluorescent material layer. For example, as a variation of the shape of the aperture 71, a quadrangle with round corners or an ellipse can be adopted.

Figure 10A:
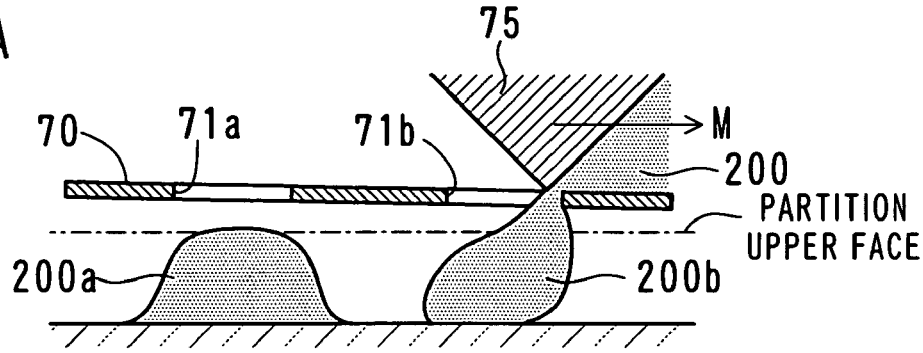
FIGS. 10A-10C are schematic diagrams showing a principle of pattern printing according to an embodiment of the present invention.
Figure 10B:
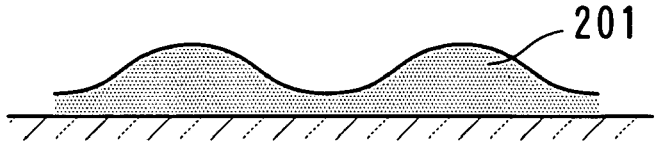
Figure 10C:
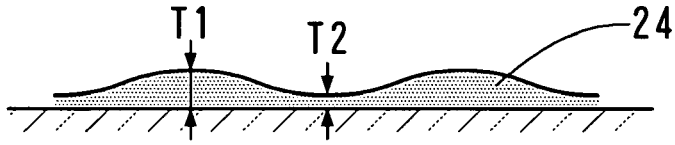

FIGS. 10A-10C are schematic diagrams showing a principle of pattern printing according to an embodiment of the present invention.

As shown in FIG. 10A, the mask 70 is disposed above the upper face of the partition with a clearance that varies gradually in the moving direction M of a squeegee 75 within a range of approximately a few millimeters as an off-contact method, so that fluorescent material paste 200 is printed in the pattern. FIG. 10A shows fluorescent material paste 200*a* that is just after being extruded through the aperture 71*a* and fluorescent material paste 200*b* that is being extruded through an aperture 71*b* neighboring an aperture 71*a*. FIG. 10B shows fluorescent material paste 201 when the printing step is finished. As being clear by comparing FIGS. 10A and 10B, according to the pattern printing of the present invention, the bodies of paste that passed through the neighboring apertures 71*a* and 71*b* are combined in the space between the partitions, and unevenness of the thickness of printed paste remains in accordance with the mask pattern. This is realized by using the fluorescent material paste 200 that is adjusted to have viscosity of approximately 100 Pa·s (=1000 poise) for example so that the paste after being extruded through the mask can flow to some extent but is not flattened completely, in other words, the paste has thixotropy.

If the fluorescent material paste has insufficient fluidity so that the bodies of paste that are extruded through the plurality of apertures 71*a* and 71*b* are not combined but are separated from each other, the printed shape tends to be uneven because of a subtle variation of the extruding condition. On the contrary, if the bodies of paste that are extruded through the plurality of apertures 71*a* and 71*b* flow appropriately to be combined, a variation of the shape of the printed paste among cells is reduced by a smoothing effect.

When the fluorescent material paste 202 after being printed and combined is dried and burned, its volume is reduced because a binder and a solvent in the paste are evaporated. Then, as shown in FIG. 10C, the fluorescent material layer 24 that inherits the unevenness of the thickness in the paste stage is formed.

In the same way as the fluorescent material layer paste 24, the green fluorescent material layer 25 and the blue fluorescent material layer 26 are formed. However, it is necessary to use masks on which the apertures 71 are arranged in accordance with the arrangement of the colors on the screen.

The chemical components of the fluorescent material paste can be the same as the conventional method. For example, $(Y,Gd)BO_3:Eu^{3+}$ can be used as the red fluorescent material, $Zn_2SiO_4$:Mn, $BaAl_{12}O_{19}$:Mn or the like can be used as the green fluorescent material, and $BaMgAl^{10}O^{17}:Eu^{2+}$ or the like can be used as the blue fluorescent material. Powder fluorescent material is added to a vehicle, and they are mixed and mulled so that the paste is obtained. As the solvent of the vehicle, hexane triol or polypropylene glycol can be used. As the binder, an acrylic resin or ethyl cellulose can be used.

According to the above-mentioned forming method, the fluorescent material layers 24, 25 and 26 were obtained, in which the thickness T12 of the fluorescent material sticking to the side face of the partition at the vicinity of the display electrode gap in each cell is larger than the thickness T22 of the fluorescent material sticking to the side face of the partition at the middle portion of the display electrode gap between cells, and the difference between the thicknesses is approximately 5 μm. The plasma display panel (a sample) having the fluorescent material layers 24, 25 and 26 as described above and a plasma display panel (comparison example) in which the thickness of the fluorescent material sticking to the side face of the partition is uniform over the entire length of the column and is the same as the thickness T22 of the above-mentioned sample are manufactured, so that luminance levels of them are compared with each other. As a result, it was confirmed that the luminance of the sample was 5% higher than that of the comparison example. In addition, the operation was stable.

Note that the above-mentioned method for forming the fluorescent material can be applied not only to formation of the fluorescent material layer of the present invention but also to formation of a fluorescent material layer having the thickness that is larger at the middle portion in the display electrode gap between cells than at the other portion, i.e., formation of the fluorescent material layer based on the concept of increasing the surface area of the fluorescent material disclosed in Japanese unexamined patent publication No. 2000-67763. In this case, when the fluorescent material paste is printed, a mask with apertures arranged so as to be adapted to the display electrode gap between cells may be used.

Figure 11:
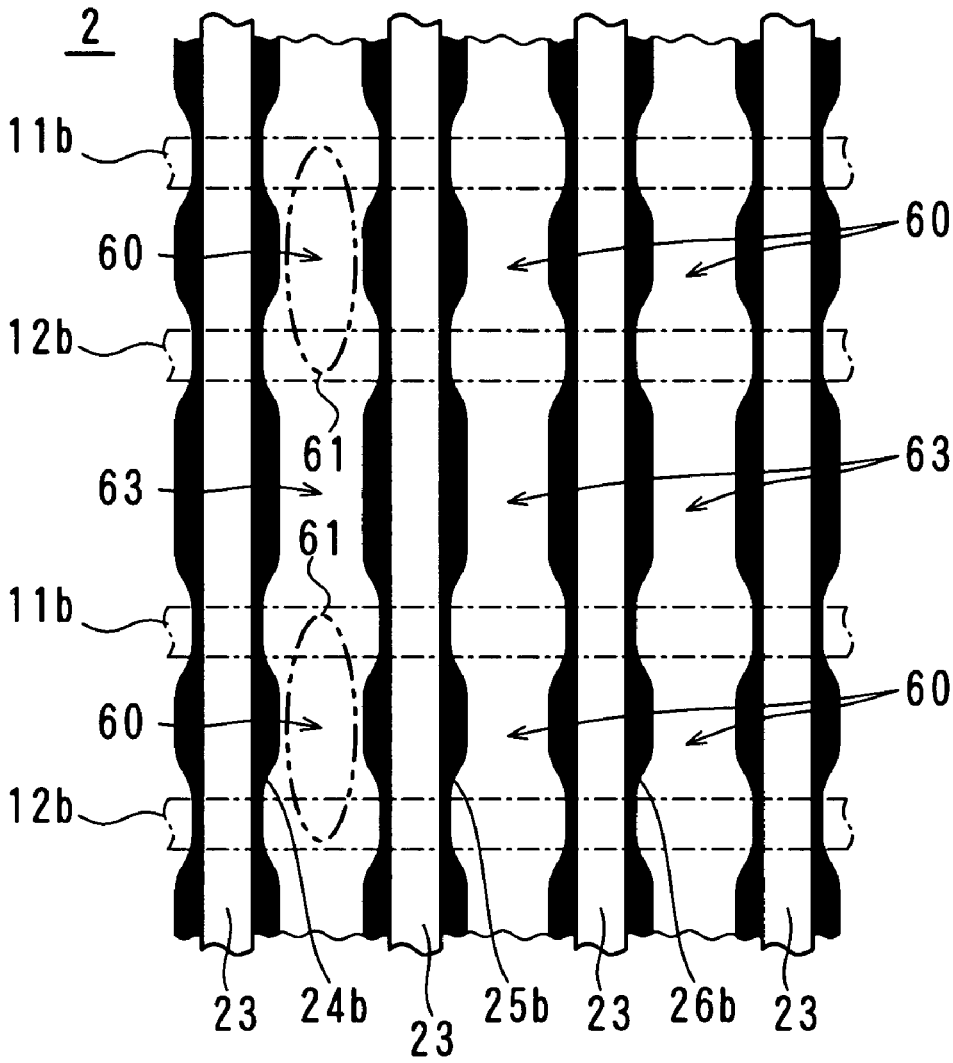
FIG. 11 is a plan view showing a variation of the shape of the fluorescent material layer.

FIG. 11 is a plan view showing a variation of the shape of the fluorescent material layer.

A plasma display panel 2 shown in FIG. 11 has the surface discharge structure that is similar to that of the above-mentioned plasma display panel 1 shown in FIG. 1. However, the plasma display panel 2 is different from the plasma display panel 1 as to the structure of row electrodes 11*b* and 12*b* and shapes of fluorescent material layers 24*b*, 25*b* and 26*b*.

Each of the row electrodes 11*b* and 12*b* is like a band having a constant width, and a pair of them is arranged on each row as the display electrodes. The row electrodes 11*b* and 12*b* can be made of a metal or a composite material that is a laminate of a transparent conductive film and a metal film. A metal electrode is advantageous from the viewpoint of reducing steps for forming the electrode. If the composite material is used for forming the electrode, a band pattern width of the transparent conductive film is designed to be larger than that of the metal film so that the transparent conductive films form the surface discharge gap.

The thickness of each of the fluorescent material layers 24*b*, 25*b* and 26*b* at the part sticking to the side face of the partition and overlapping with the row electrodes 11*b* and 12*b* is smaller than the thickness at the other parts sticking to the side face of the partition. Here, the other parts are the part located in a row electrode gap (a so-called slit) within the cell that is the surface discharge gap 60 and the part located in the row electrode gap (a so-called inverse slit) 63 between cells in the plan view.

Making the fluorescent material thick in the inverse slit (the row electrode gap 63) has an effect of suppressing interference of the surface discharge 61 between cells in each column. This effect is useful for increasing the number of arranged row electrodes by narrowing the inverse slit.

Figure 12:
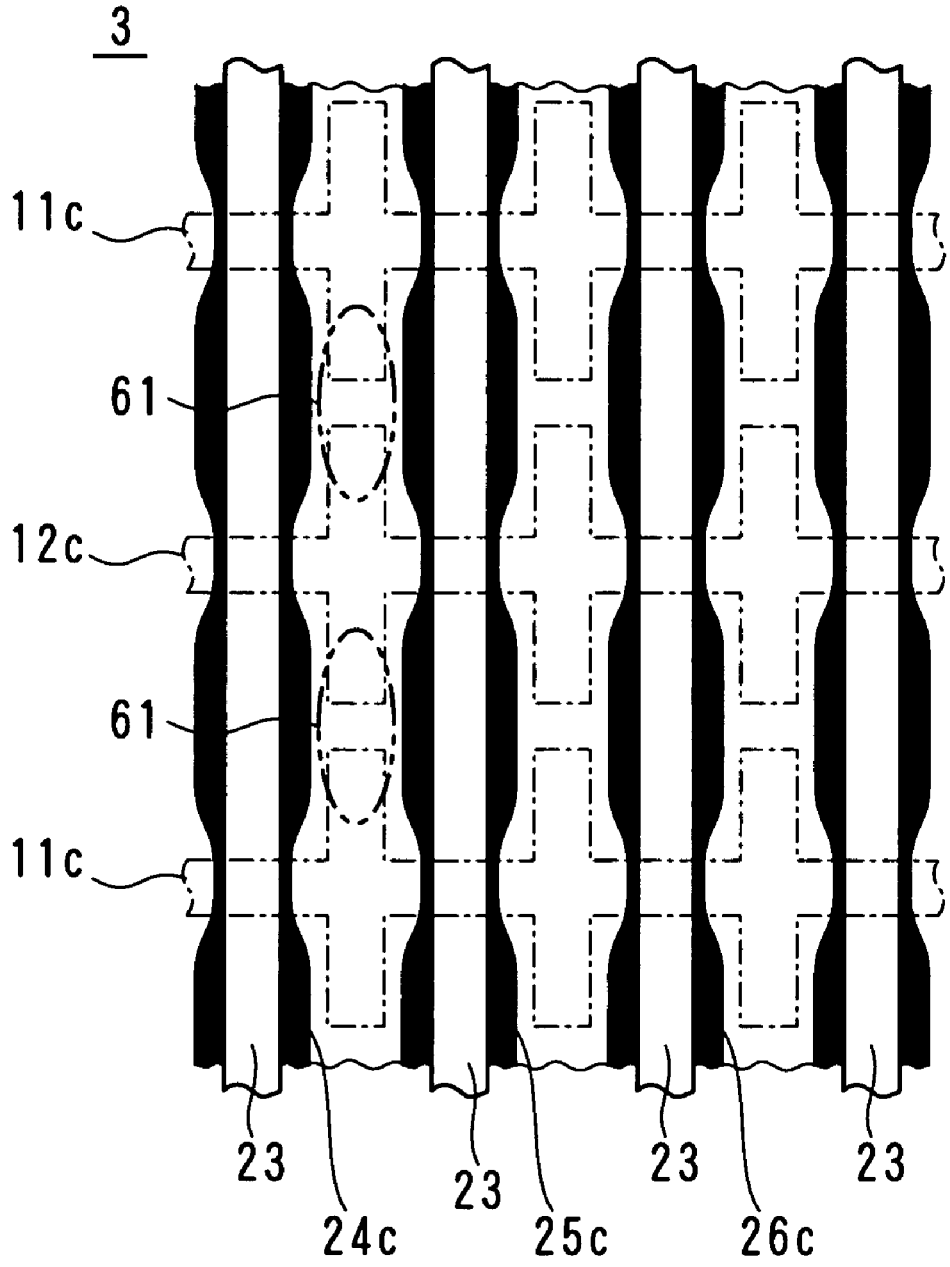
FIG. 12 is a plan view showing a variation of the row electrode arrangement.

FIG. 12 is a plan view showing a variation of the row electrode arrangement.

A plasma display panel 3 shown in FIG. 12 has the surface discharge structure that is similar to that of the above-mentioned plasma display panel 1 shown in FIG. 1. However, the plasma display panel 3 is different from the plasma display panel 1 as to the structure of row electrodes 11*c* and 12*c* and shapes of fluorescent material layers 24*c*, 25*c* and 26*c*.

Each of the row electrodes 11*c* and 12*c* is patterned to the shape having a band-like portion (a bus portion) having a constant width and extending across a plurality of cells arranged in the row direction and a plurality of protruding portions (discharge portions) protruding from both sides of the band-like portion. In each cell, the protruding portion of the row electrode 11*c* and the protruding portion of the row electrode 12*c* form a surface discharge gap. The row electrodes 11*c* and 12*c* can be made of a metal or a composite material that is a laminate of a transparent conductive film and a metal film.

The thickness of each of the fluorescent material layers 24*c*, 25*c* and 26*c* at the part sticking to the side face of the partition and overlapping with the bus portion of the row electrodes 11*c* and 12*c* is smaller than the thickness of the other part sticking to the side face of the partition. Here, the other part is located in the gap between the bus portion of the row electrode 11*c* and the bus portion of the row electrode 12*c* in the plan view.

The present invention can contribute to an improvement of luminance and stabilization of the display operation of the color plasma display panel.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A plasma display panel comprising:

first and second substrates opposed to each other for defining a space filled with discharge gas;

a screen made up of a plurality of cells arranged in row and column directions;

display electrodes arranged on the first substrate for generating surface discharges, the display electrodes extending in the row direction;

a plurality of band-like partitions arranged in parallel on the second substrate for dividing the gas filled space into columns; and fluorescent material layers sticking to side faces of the partitions and inner surfaces between the partitions on the columns, each of the fluorescent material layers having a band-like shape extending across a plurality of cells in a plan view, wherein a thickness of the fluorescent material layer at a part sticking to the side face of the partition and overlapping with the display electrode is smaller than a thickness of the fluorescent material layer at a part sticking to the side face of the partition in a vicinity of a surface discharge gap.

2. The plasma display panel according to claim 1, wherein each of the display electrodes is made up of a band-like metal film extending across a plurality of cells arranged along the display electrode and a transparent conductive film having a bus portion and protruding portions from the bus portion toward another display electrode that forms a pair with the display electrode in each cell, and the thickness of the fluorescent material layer at the part sticking to the side face of the partition and overlapping with the metal film is smaller than the thickness of the fluorescent material layer at the part sticking to the side face of the partition in the vicinity of the surface discharge gap.

3. The plasma display panel according to claim 1, wherein the display electrode is a metal electrode.

4. The plasma display panel according to claim 1, wherein a pair of the display electrodes is arranged in each of the rows, and the thickness of the fluorescent material layer at the part sticking to the side face of the partition and overlapping with the display electrode is smaller than a thickness of the fluorescent material layer at a part sticking to the side face of the partition in a middle portion of a display electrode gap between cells.

5. A method for manufacturing the plasma display panel according to claim 1, the method comprising the steps of:

disposing a mask for pattern printing that has a plurality of apertures arranged discretely along the partition above the second substrate on which the plurality of band-like partitions are formed; and printing paste of the fluorescent material in a space between the partitions by using the mask, wherein viscosity of the paste is adjusted so that bodies of the paste passing through neighboring apertures of the mask are combined in the space and that unevenness of the thickness of the printed paste remains in accordance with a mask pattern, thereby forming a fluorescent material layer, the thickness of the fluorescent material layer differing between the part sticking to the side face of the partition and overlapping with the display electrode and other parts sticking to the side face of the partition.

* * * * *